United States Patent [19]

Liaw et al.

[11] Patent Number: 5,047,088

[45] Date of Patent: Sep. 10, 1991

[54] METHOD FOR CRYSTALLIZATION OF FRUCTOSE

[75] Inventors: Gin C. Liaw; James M. Gaddy, both of Decatur, Ill.; Frank M. Mallee, Sudbury, Mass.; Steven J. Reust, Lafayette, Ind.

[73] Assignee: A. E. Staley Manufacturing Company, Decatur, Ill.

[21] Appl. No.: 374,172

[22] Filed: Jun. 30, 1989

[51] Int. Cl.[5] ..... C13F 1/02

[52] U.S. Cl. ..... 127/60

[58] Field of Search ..... 127/58, 60, 61, 62

[56] References Cited

U.S. PATENT DOCUMENTS

| | | | |
|---|---|---|---|
| 3,513,023 | 5/1970 | Kusch et al. | 127/58 |
| 3,883,365 | 5/1975 | Forsberg et al. | 127/60 |
| 3,928,062 | 12/1975 | Yamauchi | 127/60 |
| 3,981,739 | 9/1976 | Dmitrovsky et al. | 127/60 |
| 4,164,429 | 8/1979 | Mercier | 127/15 |
| 4,199,373 | 4/1980 | Dwivedi et al. | 127/60 |
| 4,199,374 | 4/1980 | Dwivedi et al. | 127/60 |
| 4,517,021 | 5/1985 | Schollmeier | 127/30 |
| 4,643,773 | 2/1987 | Day | 127/58 |
| 4,666,527 | 5/1987 | Ito et al. | 127/60 |
| 4,676,991 | 6/1987 | Batterman et al. | 426/658 |
| 4,737,368 | 4/1988 | Batterman et al. | 426/96 |

OTHER PUBLICATIONS

W. J. Genck, "Selection of Crystallizers", *Chemical Processing*, Dec., 1988, pp. 62-67.

H. M. Pancoast, et al., *Handbook of Sugars*, pp. 5-7 (AVI Publishing Company, 1980, Second Edition).

P. H. Blanchard et al., "Production of High Fructose Corn Syrups in the USA", *Sugar Technology Reviews*, vol. 11, pp. 1-93 (R. A. McGinnis et al., eds., Elsevier Science Publishers B. V., Amsterdam, The Netherlands, 1984).

*Primary Examiner*—Theodore Morris

*Assistant Examiner*—David M. Brunsman

*Attorney, Agent, or Firm*—Michael F. Campbell; J. Daniel Wood

[57] ABSTRACT

A method for producing anhydrous crystalline fructose by crystallizing from solution is provided. A highly supersaturated aqueous solution of fructose is added to a heel of crystalline fructose and dry seed. The temperature of the solution is then lowered to crystallize fructose from the solution to form a massecuite. The massecuite is divided into a product portion and a heel portion, the product portion being treated to isolated crystalline fructose which is then classified into product cuts on the basis of particle size of the fructose crystals, each product cut having a substantially typical particle size distribution.

4 Claims, No Drawings

METHOD FOR CRYSTALLIZATION OF FRUCTOSE

FIELD OF THE INVENTION

This invention relates to a method for production of anhydrous crystalline fructose by crystallization from solution.

BACKGROUND OF THE INVENTION

Fructose can exist in an anhydrous crystalline form as orthorhombic, bisphenoidal prisms which decompose at about 103°-105° C. Hemihydrate and dihydrate crystalline forms are also known, but it is preferable to void the formation of these species inasmuch as they are substantially more hygroscopic than the anhydrous form and have melting points close to room temperature which makes these crystalline forms of fructose very difficult to handle. Accordingly, as used herein, "crystalline fructose" shall refer to anhydrous crystalline fructose unless expressly stated otherwise in context.

Crystalline fructose is generally prepared by one of three ways, i.e., crystallization from solvent, crystallization from an aqueous solution, and drying of a fructose syrup.

It is possible to simply produce a dried fructose sweetener (DFS). In a DFS process, a high fructose stream derived from fractionation is dried in a rotary dryer, then sized in a classifier containing screens and grinders. U.S. Pat. No. 4,517,021 describes the preparation of such a granular, semi-crystalline, solid fructose which comprises less than about 2% water by weight. The patent discloses that about 60 weight percent of the product is crystalline fructose, and less than 35 weight percent is amorphous fructose. A drum dryer is used, with air having an initial temperature of 50°-80° C. A portion of the solid fructose product may be recycled as the crystallization initiator.

One disadvantage of a DFS process is that the product cannot be called pure fructose because it is a total sugar product and does not meet the Food Chemicals Codex criteria for "fructose." Moreover, since it is not completely crystalline, it is more hygroscopic and thus harder to handle in humid conditions than crystalline fructose.

Crystalline fructose can be prepared by a process wherein an organic solvent, such as denatured ethyl alcohol, is mixed with a high-fructose stream (95% d.s.b.). This stream crystallizes as it is cooled to form pure crystalline fructose. The product is centrifuged to separate it from the mother liquor, desolventized, and dried. U.S. Pat. No. 4,199,374 describes a process for producing crystalline fructose by the use of organic solvent. Fructose is crystallized from a high fructose corn syrup mixed with ethanol. The solution is seeded with fine crystals, e.g., particle size of 0.05 mm to 0.50 mm, of fructose or glucose and allowed to cool. The crystals are harvested by filtration, centrifugation or other suitable means. These crystals are then washed with alcohol and dried under vacuum. The moisture content of the alcohol and syrup must be carefully controlled in this process in order to obtain free-flowing fine crystals of fructose.

An aqueous process can be used to produce crystalline fructose. An aqueous crystalline fructose process typically starts with a high fructose feed stream at an elevated temperature which is cooled to crystallize the fructose from solution. A number of references describe such a process.

In U.S. Pat. No. 3,513,023, crystalline, anhydrous fructose is obtained from an aqueous solution of fructose (min. 95% d.s.). The pH of the solution must be between 3.5 and 8.0. The fructose solution is concentrated under vacuum until the water content is between 2 and 5%. The solution is cooled to 60°-85° C., seeded with crystalline fructose, and stirred vigorously while the temperature is maintained at 60°-85° C. The patentee states that a crystalline mass results which, after slow cooling, can be crumbled or ground and subsequently dried to produce a non-sticking, free-flowing, finely-crystalline powder. The process is said to avoid the formation of the glass phase product which ordinarily results when fructose solutions of this type are concentrated in a vacuum and allowed to cool in the usual manner.

In U.S. Pat. No. 3,883,365, fructose is crystallized from an aqueous fructose/glucose solution of 90% d.s. and containing 90-99% (d.s.b.) fructose. The solution is saturated (58°-65° C.). The fructose is crystallized from the solution by adding fructose crystals of homogeneous size, e.g., crystals of 5 to 10 micrometers as suspended in isopropanol or larger crystals, e.g., 80 to 100 micrometers, as dry. The formation of new crystals is minimized by keeping the distances of the seed crystals from each other suitably short and maintaining the degree of supersaturation between 1.1 and 1.2. The volume of the solution is increased, either continuously or stepwise, as the crystallization proceeds. The optimum pH of the fructose solution is said to be 5.0. The crystals so obtained reportedly have an average crystal size between 200 and 600 micrometers. Centrifugation is used to separate the crystals from the solution.

U.S. Pat. No. 3,928,062 discloses that anhydrous fructose crystals are obtained by seeding a solution containing 83-95.5% (dry basis) total sugar comprising 88-99% fructose. Crystallization may be accomplished by simply cooling the solution under atmospheric pressure or by evaporating water under reduced pressure. Formation of the hemihydrate and dihydrate are avoided by carrying out the crystallization within a certain range of fructose concentrations and temperatures. This range lies within the supersaturation area below the point at which the hemihydrate begins to crystallize out. The solution is seeded with 1 to 4% by weight of seed crystals (based on the weight of the solution) preferably having a particle size of 0.06 mm to 0.1 mm. The addition of seed crystals may be achieved using a form of massecuite which was previously prepared by suspending the crystals in the fructose solution.

In U.S. Pat. No. 4,199,373, crystalline fructose is produced by seeding a fructose syrup (88-96% d.s.b.) with 2-15 weight percent fructose seed crystals having a particle size of less than 250 micrometers, e.g., 50 to 150 micrometers, and permitting the seeded syrup to stand at about 50° to 90° F. at a relative humidity below 70%. Crystallization is said to require 2 to 72 hours. The crystalline product produced by the process is in the form of large pellets.

U.S. Pat. No. 4,164,429 describes a process and apparatus for producing crystallization seeds. A series of centrifugal separations are employed to select seed crystals from the seeded solution which fall within a predetermined size range.

U.S. Pat. No. 4,666,527 describes a process for continuously crystallizing fructose using a seed crystallization tank and a separate crystallization tank. A temperature gradient is maintained between the upper and lower portions of each tank and crystals progress from each of said upper portions to said lower portions and thereby grow. Initially, powdered seed crystals are added to the seed crystallization tank in an amount of 1 to 5%, but overflow from the crystallization tank is used as seed once a steady state of continuous operation has been established.

The selection of crystallizers and the importance of seeding in batch crystallization in general is discussed by W. J. Genck, "Selection of Crystallizers," *Chemical Processing*, December, 1988, pp. 62–67. It is noted that beginning conditions in batch crystallization are important because the initial shower of nuclei or deliberate seeding becomes part of the crystal size distribution and this initial activity can, in fact, control the final product.

The production of refined cane sugar (sucrose) is described by H. M. Pancoast et al., *Handbook of Sugars*, pp. 5–7. After centrifugation, washing and drying, the crystals of refined cane sugar can be classified according to size with screen classifiers, but Pancoast et al. note that most of the sugar is not classified because experience crystallizer operators can hold the crystal size distribution relatively constant.

The crystallization of fructose from solution produces a slurry of crystalline fructose product in mother liquor, i.e., a massecuite. The crystalline fructose product is isolated from the mother liquor, washed and dried. The dried crystalline product is then typically manipulated to ensure that it will have a desirable particle size distribution. Such manipulation generally entails dividing the particles of crystalline fructose into portions on the basis of particle size (i.e., particle size classification) and typically employs a plurality of screens. For example, the crystalline fructose product will typically be classified by screening it sequentially through two screens (the second screen having smaller openings) to retain oversized crystals and/or crystal agglomerates on the first screen and allow crystal fines to pass through the second screen. The crystalline fructose product is retained on the second screen and conveyed for further product handling.

Because products having different mean particle sizes and/or particle size distributions may be desired, the typical classification described above can be modified to introduce one or more intermediate screens upon each of which a product having a certain particle size different for each screen is retained.

SUMMARY OF THE INVENTION

This invention relates to a batch method for producing crystalline fructose from a solution comprised of fructose comprising:

crystallizing fructose from a solution of fructose to produce a first massecuite of crystalline fructose product and mother liquor, separating a major portion of said first massecuite from a minor portion of said first massecuite, mixing said minor portion of said first massecuite with i) a first dry crystalline fructose seed having a mean particle size smaller than said crystalline fructose product in said massecuite and ii) a solution of fructose at a first elevated temperature, to yield a first crystallizing mixture, lowering the temperature of said first crystallizing mixture to crystallize fructose from said solution and produce a second massecuite of crystalline fructose product and mother liquor, separating a major portion of said second massecuite from a minor portion of said second massecuite, mixing said minor portion of said second massecuite with i) a second dry crystalline fructose seed having a mean particle size smaller than said crystalline fructose product in said second massecuite and ii) a solution of fructose at a first elevated temperature to yield a second crystallizing mixture, and classifying said crystalline fructose of said major portion of said second massecuite into two or more product cuts, each product cut having a mean particle size within a predetermined range, said predetermined range being different for each product cut.

The above batch method employs in successive batches both a portion of the massecuite (i.e., a heel) and dry seed (the dry seed having a smaller mean particle size than the heel) as the seed for crystallization of fructose. The method also results in two different crystalline fructose product cuts from the same massecuite having different mean particle sizes, but each having a substantially typical particle size distribution, i.e., a distribution resembling a Gaussian curve (characterized by a single broad peak when represented graphically).

It was found that alternate use of exclusively heel and exclusively dry seed (i.e., successive batches which alternately employed heel as the seed for one batch and dry seed as the seed for the next batch) allowed for the sequential production of batches having different mean particle sizes and substantially typical particle size distributions, but in contrast to the method of this invention, the alternate use also led to process upsets (in both crystallizing and in product handling) which reduced efficiency and productivity.

DETAILED DESCRIPTION OF THE INVENTION

The first step in the method of this invention relates to crystallizing fructose from a supersaturated solution of fructose to produce a massecuite of crystalline fructose and mother liquor. This step of crystallizing can be accomplished by crystallizing from organic solvent or from aqueous solution. Examples of both types of crystallization are discussed above, e.g., in U.S. Pat. Nos. 4,199,374 and 3,883,365, respectively, the disclosures of which are incorporated by reference. While crystallization from organic solvent is feasible, crystallization from aqueous solution is preferred. Thus, the remaining description should generally be read in the context of crystallization from an aqueous solution.

The crystallization of fructose from a solution will produce a massecuite comprised of crystalline fructose product (i.e., solid crystals of fructose) and mother liquor (i.e., the liquid solvent, typically water, from which the fructose was crystallized, said solvent containing residual fructose in solution). The massecuite can be characterized as a viscous slurry, e.g., crystals suspended in mother liquor, said crystals generally comprising from about 40% to about 60% by weight of said massecuite on a total weight basis. The crystals of fructose will typically have a mean particle size of from about 200 microns to about 600 microns.

The second step of this invention relates to separating the massecuite into a major portion and a minor portion. The major portion is typically treated to harvest the crystals from the major portion of the massecuite, i.e., to separate the crystals from the mother liquor. The minor portion is employed in the process of this invention as one source of seed crystals (i.e., a heel) for the crystallization of fructose from a solution thereof.

The third step of this invention relates to mixing said minor portion of massecuite with both i) dry fructose seed to yield a composite fructose seed and ii) a solution of fructose at a first elevated temperature from which fructose can be crystallized. The resulting fructose seed is a composite in the sense that it is comprised of both i) heel from a previous fructose crystallization and ii) dry fructose seed having a mean particle size smaller than the mean particle size of the crystalline fructose product in said first minor portion of said massecuite. The weight ratio of fructose crystals in said minor portion of massecuite to said dry seed can vary widely as more fully discussed below, but will generally be from about 0.1 to about 10, typically from about 2.0 to 2.5.

The seed is mixed with a solution of fructose at an elevated temperature to seed said solution and thereby initiate the crystallization of fructose therefrom. The total weight of seed (i.e., the combined weight of heel and dry seed) in relation to the weight of added fructose solution can vary widely, but the total weight of seed will typically be about 1-10% of the weight of the fructose in solution on a dry solids basis.

The three components, i.e., heel, dry seed, and fructose solution, can be mixed in any order of addition to each other or simultaneously. However, it is most effective and efficient to simply retain the heel in a crystallization vessel, premix the dry seed and fructose solution in a seed slurry vessel and pump the resulting slurry from the seed slurry vessel to the crystallization vessel to thus add the slurry of dry seed and fructose solution to the heel.

In crystallization kinetics, the growth rate is a function of a concentration driving force—the concentration present in the mother liquor versus the concentration that would be present at that temperature at equilibrium. Supersaturation level is a measure of the concentration driving force for crystallization, i.e., the higher the level of supersaturation, the greater the driving force for crystallization. There are many ways of defining supersaturation. For fructose crystallization, it has been found that the supersaturation level defined by concentration on a water basis is the most reliable for the purpose of monitoring the progress of the batch. The fructose concentration is conveniently determined by measuring the refractive index of the solution. Thus, supersaturation level is defined as the ratio of the grams of fructose per gram of water in the supersaturated syrup to that which obtains at equilibrium:

$$\text{Supersaturation Level} = \frac{(\text{Fructose/Water})_{ACTUAL}}{(\text{Fructose/Water})_{EQUIL}}$$

The supersaturation level of the fructose solution will depend upon fructose content, solids content and temperature of the stream. For example, a fructose solution at about 95% fructose on a dry solids basis (d.s.b.) and 90% dry solids (d.s.) at about 50° C. (122° F.) will be at a supersaturation level (ss) of about 1.33. A lower fructose or dry solids content or higher temperature would result in a lower supersaturation level, and vice versa.

A feed stream of fructose solution can be obtained in a variety of ways, but is typically the product of chromatographic separation of a high fructose corn syrup as described by P. H. Blanchard et al., "Production of High Fructose Corn Syrups in the USA," *Sugar Technology Reviews*, Vol. 11, pp. 1-93 (R. A. McGinnis et al., eds., Elsevier Science Publishers B.V., Amsterdam, The Netherlands, 1984). The product of the chromatographic separation will typically be an aqueous fructose solution having a high concentration of fructose d.s.b., but a low dry solids content. Accordingly, this fructose solution can be evaporated to raise the dry solids content. The evaporation process will generally also entail raising the temperature of the fructose solution. This facilitates evaporation and also gives rise to the elevated temperature of the fructose solution at the time of seeding. To reach the desired level of supersaturation, the temperature of the fructose solution is lowered after evaporation.

The phrase "elevated temperature", without more, as used herein refers to temperatures above ambient, i.e., above 25° C. (approx. 75° F.). The "first elevated temperature" referred to herein is a temperature at which the recited supersaturation level at the time of seeding is obtained. The first elevated temperature is substantially higher than the second elevated temperature so that the lowering of the temperature will provide a driving force for the crystallization of fructose to further increase the mean particle size of the growing fructose crystals. This first elevated temperature is typically between about 52° C. (125° F.) and 60° C. (140° F.), which is sufficient (e.g., at about 95% d.s.b. fructose and 90% dry solids) to provide a substantial driving force for the crystallization of fructose.

The dry crystalline fructose seed will typically have a mean particle size being between about 100 and 200 micrometers. For example, the mean particle size is preferably between about 120 and about 175 micrometers. The seed is typically prepared by screening and/or dry milling (e.g., ground and/or sieved in a Fitzmill), but can be prepared as in U.S. Pat. No. 4,164,429 and isolated, e.g., by centrifugation.

During the lowering step of the method of this invention, the lowering of the temperature of the fructose solution (now a massecuite of crystalline fructose and mother liquor) allows one to maintain a sufficient level of supersaturation and, thus, the driving force for crystallization of fructose from the solution. This second elevated temperature is typically about 25° C. to 30° C. (approx. 80° F. to 90° F.). The rate at which the temperature is lowered should be adjusted to obtain the desired rate of crystallization. Cooling water is supplied to the heat transfer surfaces of the crystallizer at a temperature and a rate sufficient to achieve the desired rate of cooling of the massecuite. The temperature and/or rate of supply of the cooling water is adjusted to attain a high rate of cooling consistent with a temperature of the massecuite that is as uniform as possible throughout the massecuite. In other words, the progress of the crystallization can be controlled indirectly by the rate of massecuite cooling, the setpoint for the cooling water being adjusted according to predetermined cooling curve such that the desired supersaturation level is attained.

More preferably, the supersaturation level is actually measured in order to directly control the progress of the crystallization. The supersaturation level can be estimated from percent d.s. of the mother liquor alone given the initial percent d.s. and percent fructose. Using the supersaturation data, a decision can be made whether to continue a batch on a predetermined cooling curve or to modify the cooling rate so as to maintain the desired supersaturation level.

It has been found that the lowering step of the method of this invention is preferably divided into the separate periods during which the temperature is lowered at different rates, i.e., first at a relatively lower rate and then at a relatively higher rate. For example, during the initial period of cooling from the first elevated temperature, the cooling rate is preferably from about 0.25° to about 0.5° C./hr (about 0.5° to about 1.0° F./hr) to attain a desirable supersaturation level. During a later period, the cooling rate can be increased to between about 0.5° to about 1.0° C./hr (about 1.0° to 2.0° F./hr).

The rate of cooling is lower in the initial period because it has been found that the massecuite is particularly susceptible to nucleation during cooling from the first elevated temperature down to temperature between about 43° C. (110° F.) and 46° C. (115° F.). The particular temperatures and rates described above may be varied to optimize the curve for a given set of crystallization conditions without undue experimentation. The major factors which affect the temperatures are the total dry solids level (% d.s.) and the total surface area of the seed. For example, increasing the dry solids level will move the critical period to a range earlier in the cooling curve and necessitate a higher first elevated temperature, and vice versa. Decreasing the total surface area of the seed, e.g., by decreasing the amount of fructose crystallized during said maintaining, will broaden the critical period, and vice versa.

It has been found that a preferred means of cooling involves coupling a continuous monitor of the level of supersaturation to an automatic control of the cooling water temperature. In a particularly preferred means, a data processor continuously receives information about massecuite temperature, cooling water temperature and supersaturation. The processor then uses this information to control the cooling water temperature and, thus, the rate of cooling of the massecuite. In operation, the data processor is programmed to first cool the massecuite from the first elevated temperature ($T_E$) to an intermediate temperature, e.g., 46° C. (115° F.) at a slow rate, e.g., 0.25° to 0.5° C./hr (0.5° to 1° F./hr) and from 46° C. (115° F.) to a second elevated temperature (typically 30° C. or 86° F.) at a faster rate, e.g., 0.75° C./hr (1.5° F./hr). However, the program may have overrides to prevent excessive nucleation, if necessary. First, the program may provide that, in any event, the temperature difference between the massecuite and cooling water will not at any time during cooling exceed a predetermined temperature based on crystallizer design. Second, the program provides that, in any event, the level of supersaturation will not at any time during cooling exceed a predetermined value.

The lowering step produces a second massecuite of crystalline fructose and mother liquor. This second massecuite is then separated in a second major portion and a second minor portion. This second separating step and the means used to accomplish this second separating step may be different from the first separating, but are conveniently substantially identical. The second minor portion is used to repeat said mixing step, i.e., as heel for the composite seed of a further crystallizing step.

The second major portion can be subjected to an isolating step wherein the crystalline fructose product in said second major portion is isolated from the mother liquor of said second major portion. This isolating step can be accomplished by a variety of means (including, for example, filtration, decantation, and the like), but is preferably accomplished by centrifugation of said second major portion.

The crystalline fructose of said major portion is classified into two or more product cuts, i.e., divided into two or more portions, each portion having a different mean particle size within a range predetermined by the chosen means of separation. In one embodiment, the dividing yields at least two product cuts, a product cut having a larger mean particle size and a product cut having a smaller mean particle size. For example, a 35 mesh screen can be used to retain a product cut having a mean particle size of about 450 micrometers and a 75 mesh screen can be used to retain a product cut having a mean particle size of about 300 micrometers. Each of these portions will have a substantially typical particle size distribution, i.e., resembling a Gaussian curve (characterized by a single broad peak). The cuts can be isolated either before or after said dividing, i.e., the classification can be performed on the slurry of massecuite or on crystalline fructose isolated from the massecuite. In this regard, conventional classification techniques can generally be employed, e.g., wet classification such as screening of the massecuite or dry classification such as screening crystalline fructose isolated from the massecuite. The product cuts can be dried and packed according to conventional techniques.

In addition, the dividing will generally yield a fines cut, i.e., a cut having a mean particle size smaller than the product cuts. The dividing may also yield an overs cut, i.e., a cut having a mean particle size larger than the product cuts. The fines cut and overs cut are typically remelted to prepare a fructose solution for crystallization. The fines cut may be suitable as is for use as the dry seed employed as above or may be useful in preparing such dry seed, e.g., by further dividing or controlled remelting of the smaller particles in the fines. Likewise, the overs cut may be ground to provide seed.

The relative size of the cuts having larger and smaller particle sizes can be varied by adjusting the ratio of the fructose crystals in the heel to those of the dry seed. For example, by increasing the weight ratio of heel to dry seed, the cut of the resulting massecuite having a larger mean particle size will be increased in weight relative to the weight of the cut having a smaller mean particle size. The converse is also possible, i.e., by decreasing the weight ratio of heel to dry seed, the cut of the resulting massecuite having a larger mean particle size will be decreased in weight relative to the cut having a smaller mean particle size. Thus, the ratio of heel to dry seed can be used to determine the relative size of each cut of the massecuite.

The crystalline fructose product cuts produced by the method of this invention can be used in a variety of different ways in a variety of foods. Typical applications include dry mixes in which the crystalline fructose provides at least a portion of the sweet flavor notes of the food. Examples of uses for crystalline fructose can be found in U.S. Pat. Nos. 4,676,991 and 4,737,368. Because these product cuts each have a substantially typical particle size distribution, each should perform substantially as though each was produced separately in a crystallization employing only heel or dry seed.

The following example will serve to illustrate the invention without limiting the scope thereof unless expressly noted otherwise. All parts, percentages and ratios herein are by weight unless specified otherwise in context.

EXAMPLE

A crystallizer was charged with 4,000 lbs. of dry crystalline fructose having a mean particle size of about 150 micrometers and 12,500 gal. of 95% d.s.b. fructose syrup at 90% dry solids and an elevated temperature. The temperature was lowered and a massecuite of crystalline fructose in mother liquor was obtained with about 45% to about 50% of the fructose in said fructose syrup having been crystallized. Approximately 90% of the massecuite was removed from the crystallizer and 10% of the massecuite was retained as a heel in the crystallizer, which heel contains about 50% crystals by weight, as is. To this 10% of massecuite retained as a heel was added 2,000 lbs. of dry crystalline fructose having a mean particle size of about 150 micrometers as a dry seed and 11,250 gal. of 95% d.s.b. fructose syrup at 90% dry solids and at an elevated temperature.

The temperature of the mixture described above was lowered and a massecuite of fructose crystals in mother liquor was obtained. A 90% portion of the massecuite was removed from the crystallizer, isolated by centrifugation, washed and dried. The resulting dry crystals were dry screened into two product cuts and a fines cut (fines through a 75 mesh screen). Of the crystals collected in the two product cuts, about 25% by weight was collected as a larger particle size product on a 35 mesh screen (having a mean particle diameter (volume) of approximately 450 micrometers and a substantially typical particle size distribution) and 75% by weight through the 35 mesh screen and on a 75 mesh screen as a smaller particle size product (having a mean particle diameter (volume) of approximately 300 micrometers and a substantially typical particle size distribution).

The 10% portion of the massecuite retained in the crystallizer was then mixed with 2,000 lbs. of dry crystalline fructose having a mean particle size of about 150 micrometers and 11,250 gal. of 95% d.s.b. fructose syrup at 90% dry solids and at an elevated temperature.

What is claimed is:

1. A batch method for producing crystalline fructose from an aqueous solution comprised of fructose comprising:

crystallizing fructose from a solution of fructose to produce a first massecuite of crystalline fructose product and mother liquor, separating a major portion of said first massecuite from a minor portion of said first massecuite, mixing said minor portion of said first massecuite with i) a first dry crystalline fructose seed having a mean particle size smaller than said crystalline fructose product in said massecuite and ii) a solution of fructose at a first elevated temperature, to yield a first crystallizing mixture, lowering the temperature of said first crystallizing mixture to crystallize fructose from said solution and produce a second massecuite of crystalline fructose product and mother liquor, separating a major portion of said second massecuite from a minor portion of said second massecuite, mixing said minor portion of said second massecuite with i) a second dry crystalline fructose seed having a mean particle size smaller than said crystalline fructose product in said second massecuite and ii) a solution of fructose at a first elevated temperature to yield a second crystallizing mixture, and classifying said crystalline fructose of said major portion of said second massecuite into two or more product cuts, each product cut having a mean particle size within a predetermined range, said predetermined range being different for each product cut.

2. A method of claim 1 further comprising:

lowering the temperature of said second crystallizing mixture to crystallize fructose from said solution and produce a third massecuite of crystalline fructose product and mother liquor, separating a major portion of said third massecuite from a minor portion of said third massecuite, and dividing said crystalline fructose of said major portion of said third massecuite into two or more cuts, each cut having a mean particle size within a predetermined range, said predetermined range being different for each cut.

3. A method of claim 2 further comprising varying the ratio of said minor portion of said second massecuite to said second dry crystalline fructose seed from the ratio of said minor portion of said first massecuite to said first dry crystalline fructose seed to vary the size of each of said cuts as a percentage by weight of said major portion of said third massecuite from the size of each of said cuts as a percentage by weight of said major portion of said second massecuite.

4. A method of claim 1 wherein each of said two or more cuts of crystalline fructose of said major portion of said second massecuite have a substantially typical particle size distribution.

* * * * *